US005957031A

United States Patent [19]

Kladiwa

[11] Patent Number: 5,957,031

[45] Date of Patent: Sep. 28, 1999

[54] HYDRAULIC CYLINDER

[75] Inventor: Wolfgang Kladiwa, Huglfing, Germany

[73] Assignee: Hoerbiger Ventilwerke Akt., Vienna, Austria

[21] Appl. No.: 08/888,699

[22] Filed: Jul. 7, 1997

Related U.S. Application Data

[63] Continuation of application No. 08/588,410, Jan. 18, 1996.

[30] Foreign Application Priority Data

Jan. 18, 1995 [AT] Austria ..... A 66/95

[51] Int. Cl.[6] ..... F15B 15/22

[52] U.S. Cl. ..... 92/15; 92/19; 92/169.1

[58] Field of Search ..... 92/15, 18, 19, 92/23, 24, 128, 165 R, 168, 169.1; 296/117

[56] References Cited

U.S. PATENT DOCUMENTS

| | | | |
|---|---|---|---|
| 2,845,902 | 8/1958 | Anderson | 92/19 |
| 3,518,920 | 7/1970 | Bimba | 92/165 R |
| 3,528,346 | 9/1970 | Lee | 92/165 R |
| 3,886,849 | 6/1975 | Roberts et al. | 92/168 |
| 4,078,778 | 3/1978 | Hubweber | 92/19 |
| 4,185,539 | 1/1980 | Stratienko | 92/24 |
| 4,458,887 | 7/1984 | Shimokura et al. | 92/19 |
| 4,534,269 | 8/1985 | Scerbo et al. | 92/23 |
| 4,969,388 | 11/1990 | Kolhoff et al. | 296/117 |
| 5,279,119 | 1/1994 | Shelhart et al. | 296/117 |

OTHER PUBLICATIONS

Tool Engineer's Handbook, 1st Ed., New York, McGraw–Hill, 1949, pp. 989, 1006–1009.

*Primary Examiner*—F. Daniel Lopez
*Attorney, Agent, or Firm*—Watson Cole Grindle Watson, P.L.L.C.

[57] ABSTRACT

In order to facilitate a simple and cost-effective manufacture of a hydraulic cylinder, the cylinder tube (3) is provided as smooth stock with connectors (9) set up, preferably stud-welded, for the hydraulic attachments (1,2). Assembly parts provided in the cylindrical tube (3), such as the base (10), seal (7), guide casing (8) and fixing device (4), are held inside the cylindrical tube (3) by means of non-cut, indented locking regions (11, 12, 13).

5 Claims, 5 Drawing Sheets

HYDRAULIC CYLINDER

CROSS-REFERENCE TO RELATED APPLICATION

This application is a continuation of application Ser. No. 08/588,410, filed Jan. 18, 1996, now abandoned.

BACKGROUND OF THE INVENTION

1. Field of the Invention

The invention relates to a hydraulic cylinder, particularly a hydraulic power cylinder for actuation of equipment, such as, for example, hoods on vehicles, the hydraulic cylinder including a cylindrical tube with a hydraulic attachment on at least one end and a sealed drive piston inside connected to the equipment to be actuated by a piston rod which itself can be fixed relative to the cylindrical tube by means of a fixing device.

2. The Prior Art

Hydraulic power cylinders for actuation of various equipment on vehicles are today subject, as major items, to relatively strict cost pressures so that most new features for these technically simple and mature components are more likely to deal with cost reduction by reduction in manufacturing and/or installation or storage costs. On the other hand, the respective improvements also must provide that the applications of these types of equipment or structural elements can also be expanded to areas in which, up until now, high costs have been the factor deciding against it.

In known arrangements of the type mentioned above, it has already been suggested, for example, that the cylindrical tube be built as a cast aluminum part closed on one end and having the required attachments for the hydraulic medium formed therewith in one piece. After production of the raw casting, the required forming is undertaken by machining prior to final assembly. On the other hand, hydraulic cylinders of the type mentioned above are known in which separately manufactured cover and base parts, which have the required attachments, seals, lines, and the like, are connected to a straight pipe section with minimal wall thickness used in between as the cylinder. In both cases, the final assembly is relatively simple, whereas the processing steps required for the manufacture of the cast parts, in particular, are more complicated and thus make the entire element relatively expensive.

The object of the present invention is to provide a hydraulic cylinder of the type mentioned above but wherein the associated disadvantages of the known arrangements are avoided and the manufacture and assembly are simpler and more cost effective.

SUMMARY OF THE INVENTION

This object is achieved by providing the cylindrical tube as smooth stock without significant machining with welded, particularly stud-welded, connecting parts for the hydraulic attachment(s), and by fastening assembly parts inside the cylindrical tube, i.e., base, seal, guide casing and fastening device, with non-cut, indented locking regions extending inwardly of the cylindrical tube. Instead of, as initially mentioned, completion of a smooth stock with minimal wall thickness with complicated constructed and hard-to-manufacture base and cover sections, the connecting parts for hydraulic attachments are separately welded to the cylindrical tube, preferably placed with stud welds. The stud-weld itself is used today as a modern fastening or connecting technique throughout the metal-working industry to the most far-reaching extents. According to the application and demands, various processing variations find use, wherein mainly arc welding is used. According to DIN 1910, part 2, stud-welding is in the category of electric arc pressure welding, wherein the grade protection is documented in DIN 8563, part 10. In the whole, this is a simple and precisely carried out process which facilitates very cost-effective processing.

The cylindrical tube thus does not need to be worked prior to attachment of the connecting pieces for the hydraulic attachments—deburring and the like notwithstanding. A manufacturing process design has been proven especially advantageous according to which the connecting parts for the hydraulic attachments are without drillings prior to assembly as well as the cylindrical tube at this location and only after welding is it provided with the connection drillings which penetrate the cylindrical tube as well. These connection drillings can either be produced in a non-cutting way (for example pressed or punched), or by means of usual machining techniques (drilling, milling or the like).

The assembly parts to be provided in the cylindrical tube are, either before or after the attachment of the connection parts, held by means of non-cut, indented locking regions in the cylindrical tube, wherein a particularly preferred variation is distinguished in that the locking region is constructed from stamped forms, particularly balls, on both sides of the fixing device separated at a right angle along the outside of the tube with no change in the form of the cylindrical tube. The ends of the cylindrical tube can be further beaded or indented or the like, which facilitates a very simple overall and cost effective manufacture while ensuring the required functioning of the assembled parts.

Further features and advantages of the invention will be understood by reference to the attached drawings, taken in conjunction with the following discussion.

DETAILED DESCRIPTION OF THE PREFERRED EMBODIMENTS

Figure 1:
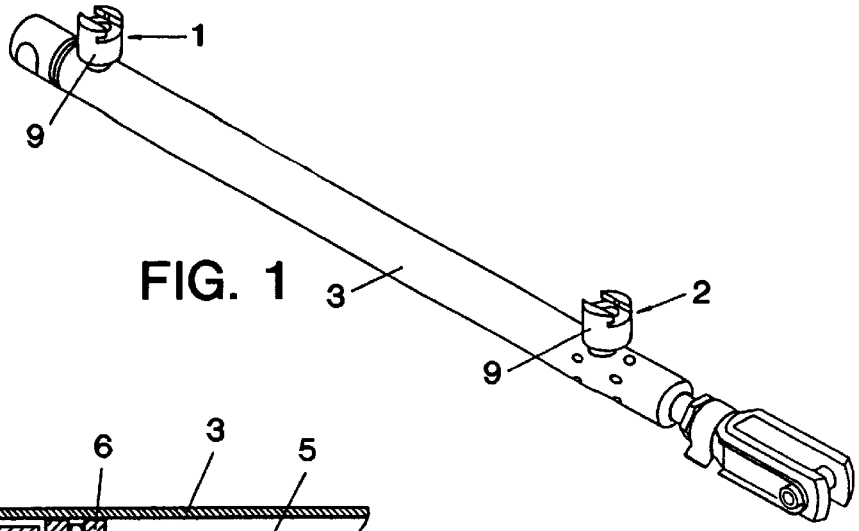
FIG. 1 is a perspective view of a hydraulic cylinder according to a preferred embodiment of the present invention.
Figure 2:
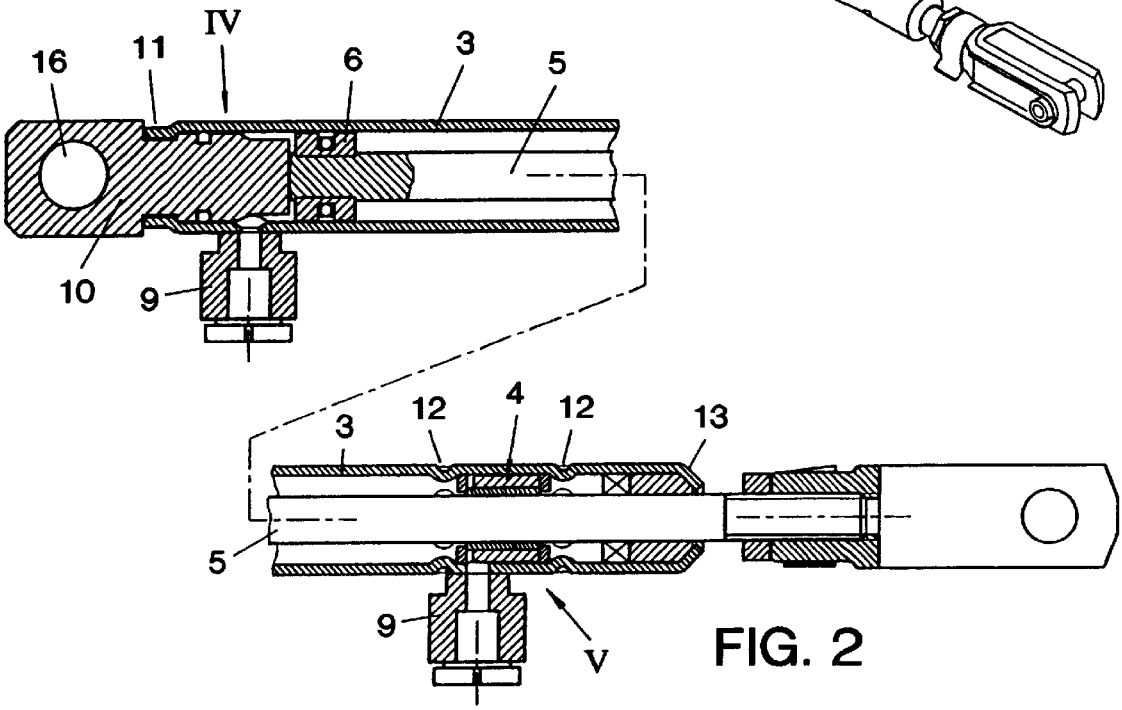
FIG. 2 depicts a first central axial section through the hydraulic cylinder of FIG. 1.
Figure 3:
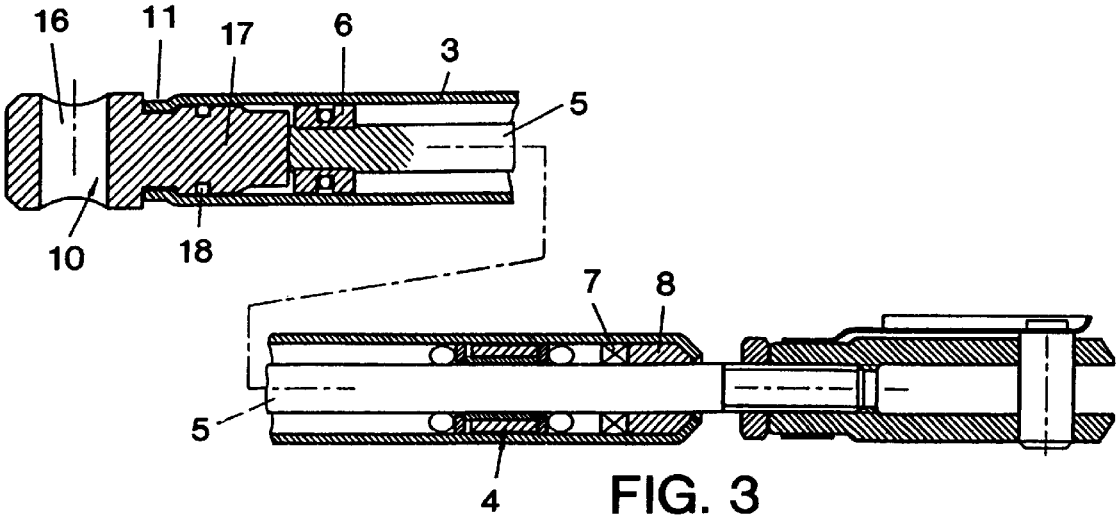
FIG. 3 depicts a second central axial section through the hydraulic cylinder which is perpendicular to the first central axial section of FIG. 2.

A hydraulic cylinder according to a first preferred embodiment of the invention is shown in FIGS. 1–5. It is intended for power actuation of a vehicle cover (not shown) and consists essentially of a cylinder tube 3 with dual hydraulic connectors 1, 2 and a piston 6 guided in sealed fashion within the cylinder tube 3 and connected by a piston rod 5, which can be fixed relative to the cylindrical tube 3 by means of a fixing device 4, to the equipment to be actuated (not shown). The piston rod 5 extends out of the end of the cylindrical tube 3 which contains a ring gasket 7 between the fixing device 4 and the end of the cylindrical tube, as well as a guide casing 8 (made for example of plastic).

The cylindrical tube 3 is provided as smooth stock without any significant machining. Stud-welded connectors 9 for the hydraulic attachments 1, 2 are attached thereto, the connectors having various possible constructions as shown in FIGS. 10–15 and explained below in more detail.

The assembly pieces provided in the cylindrical tube 3, such as base 10, seal 7, guide casing 8 and fixing device 4 are held in the cylindrical tube 3 by means of non-cut, indented locking regions 11, 12, 13, wherein the technique for the manufacture of locking region 12 is illustrated in FIGS. 6–9.

Figure 6:
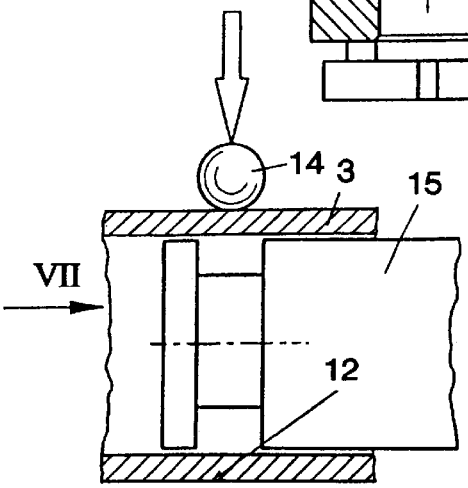
FIG. 6 is a partial axial section of the inventive hydraulic cylinder depicting the forming of a non-cut, indented locking region in the cylinder tube.
Figure 7:
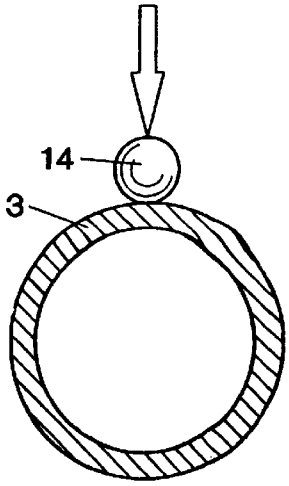
FIG. 7 view as seen along arrow VII in FIG. 6.
Figure 8:
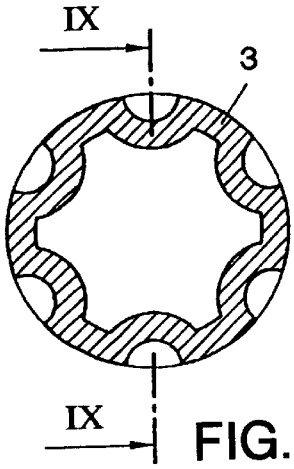
FIG. 8 is a cross-section through a cylindrical tube formed in a non-cut manner for manufacture of a locking region.
Figure 9:
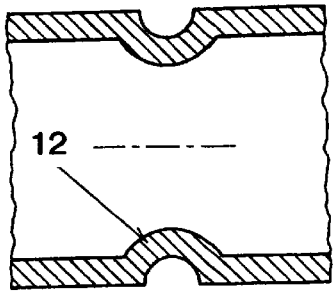
FIG. 9 is a section along line IX—IX in FIG. 8.

The cylindrical tube 3, which at the beginning of the manufacture is essentially smooth and merely deburred is, for example, provided with locking regions 12 on both sides for securing the inserted fixing device 4 such that according to FIGS. 6–9, forming parts 14, for example balls, are stamped in from the outside with no change in the form of the cylindrical tube 3 at a right angle separated along the exterior of the tube, whereby a propping tool 15 can be arranged inside the cylindrical tube 3 according to FIG. 6. In this way, locking regions 12 arise, as seen in FIGS. 8 and 9, which make a lateral shift of the fixing device 4 impossible and without which various additional carriage parts would be required. Notwithstanding the arrangement represented and distribution of the individual impressions by the forming part(s) 14, other non-cutting forming techniques could naturally be applied for the manufacture of the locking regions. For example, a corresponding non-cut indentation for securing of the fixing device 4 could be carried out with known rolling techniques or the like.

The laid-out connectors 9 for the hydraulic attachments 1, 2 can be preferably non-drilled prior to assembly the same as the cylindrical tube 3 at these respective locations and be provided with the connector holes, also penetrating the cylindrical tube 3, only after welding, or stud welding. Corresponding variations of connectors 9 are represented in FIGS. 10–15.

Figure 10:
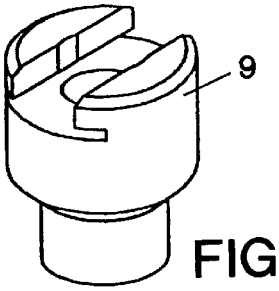
FIGS. 10–15 depict various connectors for the hydraulic cylinder, FIGS. 10, 12 and 14 being perspective views and FIGS. 11, 13 and 15 being respective cross-sectional views thereof.
Figure 11:
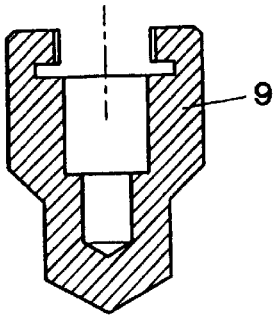

The connector 9 according to FIGS. 10 and 11 is conceived for a male or female insertable connector of the hydraulic line and is drilled after attachment or stud-welding to the cylindrical tube, not shown here, along with the tube.

Figure 12:
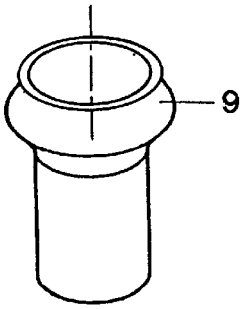
Figure 13:
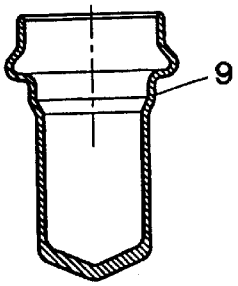

The connector 9 according to FIGS. 12 and 13 is constructed as a deep drawn part for a plug connector which results in a very price-favorable solution. After fastening, the required penetrations in the cylinder can be produced, for example, also without cutting by pressing or stamping.

Figure 14:
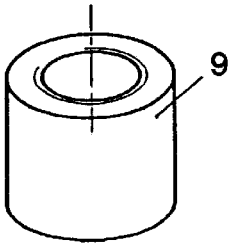
Figure 15:
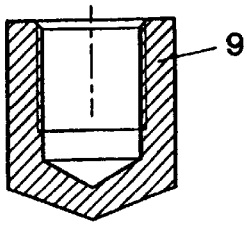

According to FIGS. 14 and 15, connector 9 is provided with inner threading for threading of the connector of the hydraulic line. Here, as well, the required connection in the cylindrical interior need be produced only by, for example, boring after attachment or stud-welding.

Figure 4:
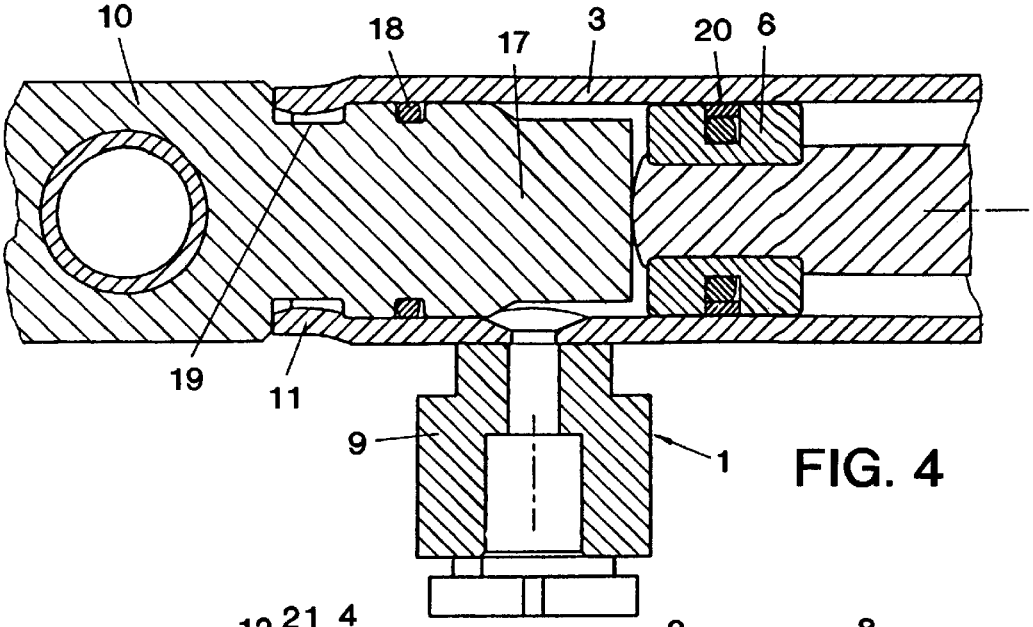
FIG. 4 is an enlarged detail of end portion VI of FIG. 2.

The base 10 of the hydraulic cylinder, which has a hole 16 for fastening or fixing of the hydraulic cylinder, is inserted into the (still un-formed) open end of the cylindrical tube 3 according to FIGS. 1 through 4 sealed at one insert region 17 by means of a ring gasket 18, whereupon the end of the cylindrical tube 3—as particularly evident in FIG. 4—is pressed onto carrier region 11 and solidly connects the base 10 with the cylindrical tube 3 together with a notch 19 at insert region 17. The insert region 17 is pulled inward here at its cylinder-side inner end over the associated hydraulic connector 1 with smaller diameter compared to the inner wall of the cylindrical tube 3 and thus forms an end plate for the piston 6 or piston rod 5, sealed by a sealing arrangement 20.

Figure 5:
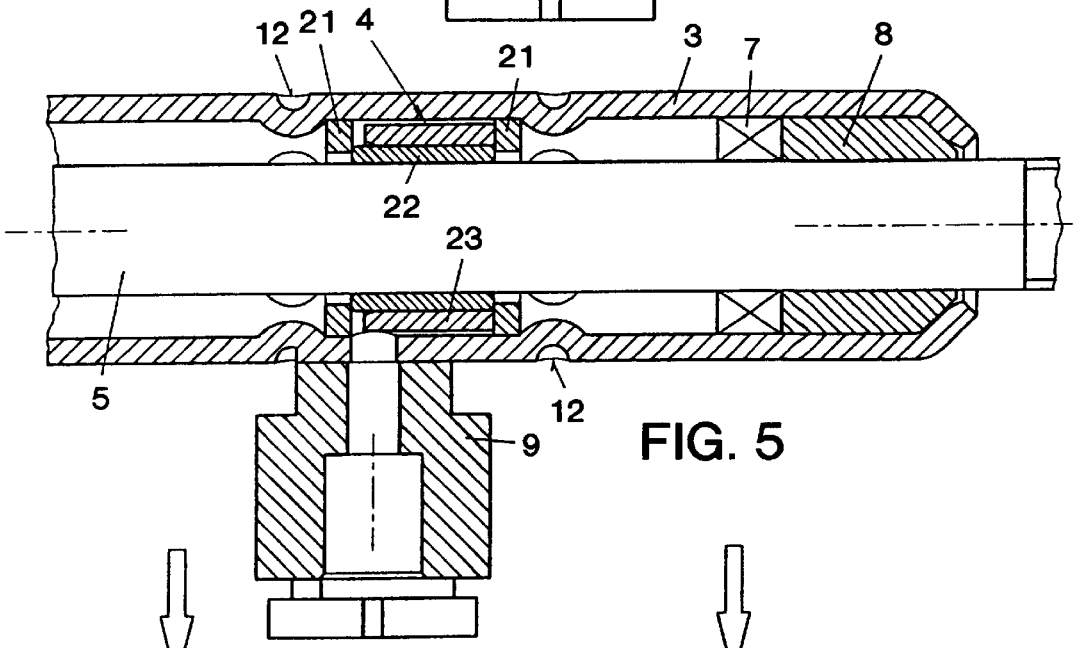
FIG. 5 is an enlarged detail of end portion V of FIG. 2.

Finally, FIG. 5 shows that the locking region 12 closer to the cylindrical interior on the fixing device 4 also acts at the same time as an end plate for the piston 6 when piston rod 5 is pushed out. The fixing device 4 consists essentially of two lateral carriers 21, between which an inner friction casing 22 and an outer clamp casing 23 are arranged, which, as a result of the increased static friction, fix the piston rod 5 when hydraulic medium pressure is not applied. Notwithstanding the above, the fixing device 4 could naturally also be constructed from other marketable means.

Figure 16:
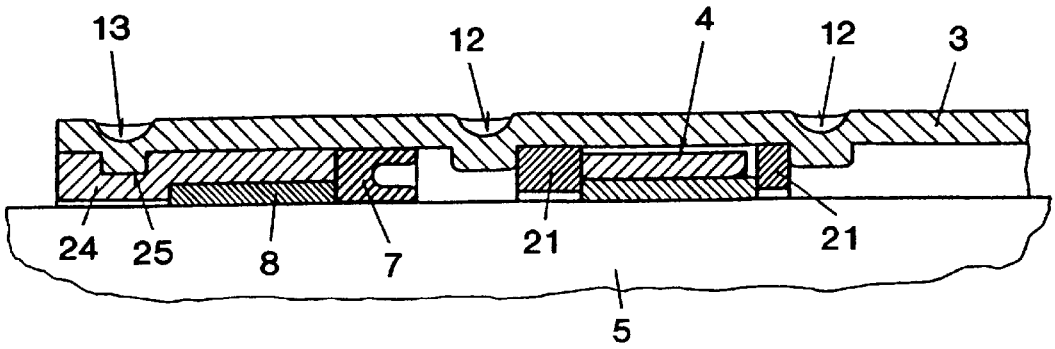
FIGS. 16 and 17 are partial cross-sectional views similar to FIG. 5 of alternative embodiments of the invention.

In FIG. 16, another embodiment of the hydraulic cylinder is represented in which—similar to FIG. 5—the fixing device 4 is again held by interpositioning of carrier rings 21 by locking region 12 (formed as discussed concerning FIGS. 6–9) in cylindrical tube 3, in which a separate carriage ring 24, which has a surrounding notch 25 into which the individual impressions of the locking region 13, formed in like fashion according to FIGS. 6–9, engage, is inserted at the end of the cylindrical tube 3 for holding of the ring gasket 7 and the guide casing 8.

Figure 17:
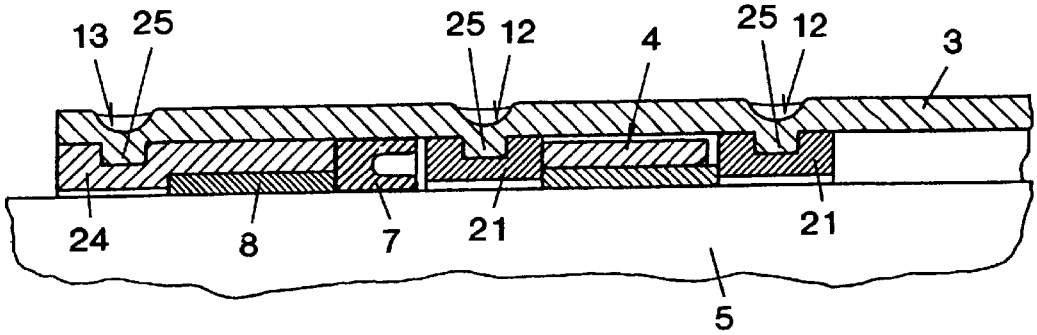
Figure 18:
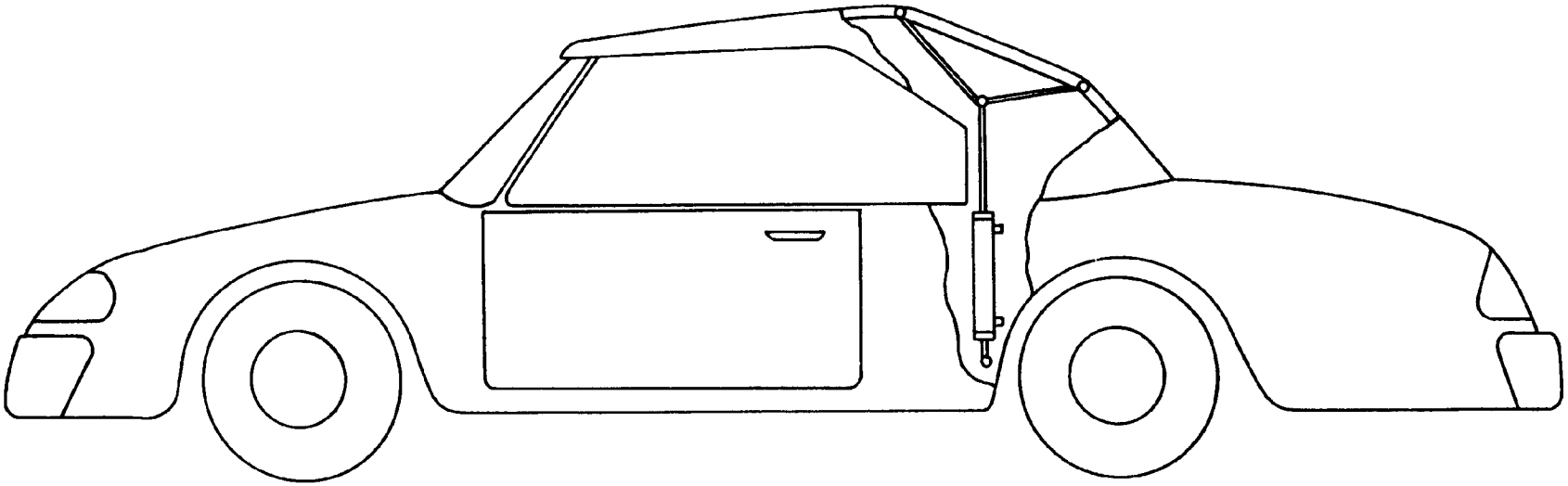
FIG. 18 schematically depicts the hydraulic cylinder of the present invention in combination with a vehicle.

In order to eliminate with certainty the formation of axial tensioning of the fixing device 4 by projection of the locking region 12, somewhat wider carriage rings 21 are provided according to FIG. 17, which—similar to the carriage ring 24 in FIG. 16—have peripheral notches 25 into which the projections pressed inward of the carriage region 12 engage.

A hydraulic cylinder is obtained by the described arrangement in its entirety, which is simple to manufacture and thus cost-effective and offers great advantages in mass production.

I claim:

1. A hydraulic cylinder for use in operating a convertible top of a vehicle which includes a cylindrical tube having opposite first and second ends, a base element extending into the cylindrical tube from said first end thereof, a seal means within the cylindrical tube near said second end thereof, a guide casing within the cylindrical tube between said seal means and said second end thereof, a sealed drive piston movably positioned within the cylindrical tube, a piston rod which extends from said drive piston through said seal means and said guide casing out of said second end of the cylindrical tube, a fixing means within the cylindrical tube which frictionally contacts the piston rod and tends to prevent movement of the the piston rod and drive piston in the cylindrical tube, and a hydraulic connector element stud welded to the cylindrical tube to supply hydraulic fluid to the cylindrical tube to overcome the frictional contact of the fixing means on the piston rod and move the drive piston within the cylindrical tube, said cylindrical tube including a first non-cut, indented locking region for fixedly locating the guide casing and the seal means within the cylindrical tube and second and third non-cut, indented locking regions at opposite ends of the friction fixing means for fixedly locating the fixing means in the cylindrical tube.

2. In a method of manufacturing a hydraulic cylinder for use in operating a convertible top of a vehicle which includes a cylindrical tube having opposite first and second ends, a base element extending into the cylindrical tube from said first end thereof, a seal means within the cylindrical tube near said second end thereof, a guide casing within the cylindrical tube between said seal means and said second end thereof, a sealed drive piston movably positioned within the cylindrical tube, a piston rod which extends from said drive piston through said seal means and said guide casing out of said second end of the cylindrical tube, a fixing means within the cylindrical tube which frictionally contacts the piston rod and tends to prevent movement of the the piston rod and drive piston in the cylindrical tube, and a hydraulic connector element stud welded to the cylindrical tube to supply hydraulic fluid to the cylindrical tube to overcome the frictional contact of the fixing means on the piston rod and move the drive piston within the cylindrical tube, said method including the steps of providing a smooth, deburred cylindrical tube, positioning the fixing means in said cylindrical tube, and indenting the cylindrical tube to fix the guide casing and seal means in position within the cylindrical tube and indenting at two spaced locations corresponding to opposite ends of the fixing means to provide non-cut, indented locking regions which fixedly position the fixing means within the cylindrical tube.

3. In a method according to claim 2, wherein said indenting step is accomplished by pressing a plurality of balls located around a periphery of the cylindrical tube radially inwardly thereof.

4. In a method according to claim 2, including the step of indenting the cylindrical tube in an additional location to provide a non-cut, indented locking region which fixedly positions the base element in a position within the cylindrical tube.

5. A combination of a vehicle having a body and a top which is movably connected to the body, and a hydraulic cylinder connected between the body and the top to move the top relative to the body, said hydraulic cylinder including a cylindrical tube having opposite first and second ends, a base element extending into the cylindrical tube from said first end thereof, a seal means within the cylindrical tube near said second end thereof, a guide casing within the cylindrical tube between said seal means and said second end thereof, a sealed drive piston movably positioned within the cylindrical tube, a piston rod which extends from said drive piston through said seal means and said guide casing out of said second end of the cylindrical tube, a fixing means within the cylindrical tube which frictionally contacts the piston rod and tends to prevent movement of the the piston rod and drive piston in the cylindrical tube, and a hydraulic connector element stud welded to the cylindrical tube to supply hydraulic fluid to the cylindrical tube to overcome the frictional contact of the fixing means on the piston rod and move the drive piston within the cylindrical tube, said cylindrical tube including a first non-cut indented locking region for fixedly locating the guide casing and the seal means within the cylindrical tube and second and third non-cut, indented locking regions at opposite ends of the friction fixing means for fixedly locating the fixing means in the cylindrical tube.

* * * * *

UNITED STATES PATENT AND TRADEMARK OFFICE

CERTIFICATE OF CORRECTION

PATENT NO. : 5,957,031

DATED : September 28, 1999

INVENTOR(S) : Wolfgang KLADIWA

It is certified that error appears in the above-identified patent and that said Letters Patent is hereby corrected as shown below:

On the title page, item:

[73] Assignee: Hoerbiger Hydraulik GmbH, Schongau, Germany

Signed and Sealed this

Second Day of May, 2000

*Attest:*

Q. TODD DICKINSON

*Attesting Officer*

*Director of Patents and Trademarks*